US005470372A

United States Patent [19]

Weinl

[11] Patent Number: 5,470,372

[45] Date of Patent: Nov. 28, 1995

[54] SINTERED EXTREMELY FINE-GRAINED TITANIUM-BASED CARBONITRIDE ALLOY WITH IMPROVED TOUGHNESS AND/OR WEAR RESISTANCE

[75] Inventor: Gerold Weinl, Alvsjo, Sweden

[73] Assignee: Sandvik AB, Sandviken, Sweden

[21] Appl. No.: 79,604

[22] Filed: Jun. 22, 1993

[30] Foreign Application Priority Data

Jun. 22, 1992 [SE] Sweden ..... 9201928

[51] Int. Cl.[6] ..... C22C 29/04; B22F 3/00

[52] U.S. Cl. ..... 75/238; 75/242; 419/16; 419/33; 419/38

[58] Field of Search ..... 75/238, 239, 240, 75/241, 242; 419/23, 31, 32, 33, 38

[56] References Cited

U.S. PATENT DOCUMENTS

| | | | |
|---|---|---|---|
| 3,971,656 | 7/1976 | Rudy | 75/203 |
| 4,623,402 | 11/1986 | Maximov et al. | 148/20.3 |
| 4,894,090 | 1/1990 | Ekemar et al. | 75/252 |
| 5,032,174 | 7/1991 | Ekemar et al. | 75/354 |
| 5,137,565 | 8/1992 | Thelin et al. | 75/238 |
| 5,147,831 | 9/1992 | Zeiringer et al. | 501/96 |
| 5,149,361 | 9/1992 | Iyori et al. | 75/233 |
| 5,186,739 | 2/1993 | Isobe et al. | 75/238 |

FOREIGN PATENT DOCUMENTS

| | | |
|---|---|---|
| 417302 | 3/1991 | European Pat. Off. . |
| 464396 | 1/1992 | European Pat. Off. . |
| 61-295352 | 5/1987 | Japan . |
| 62-170451 | 7/1987 | Japan . |

*Primary Examiner*—Ngoclan Mai

*Attorney, Agent, or Firm*—Burns, Doane, Swecker & Mathis

[57] ABSTRACT

There is now provided a sintered titanium-based carbonitride alloy for metal cutting containing hard constituents based on Ti, Zr, Hf, V, Nb, Ta, Cr, Mo and/or W and 3–30% binder phase based on Co and/or Ni. The structure contains well-dispersed and/or as agglomerates, 10–50% by volume hard constituent grains essentially without core-rim structure with a mean grain size of 0.8–5 μm in a more fine-grained matrix with a mean grain size of the hard constituents of <1 μm. The matrix is made from a powder being prepared from an intermetallic pre-alloy disintegrated to <50 μm particle size and then carbonitrided in situ to extremely fine-grained hard constituents having a diameter ≦0.1 μm within the binder phase metals.

4 Claims, 2 Drawing Sheets

SINTERED EXTREMELY FINE-GRAINED TITANIUM-BASED CARBONITRIDE ALLOY WITH IMPROVED TOUGHNESS AND/OR WEAR RESISTANCE

BACKGROUND OF THE INVENTION

The present invention relates to a sintered carbonitride alloy having titanium as the main component and intended preferably for metal cutting applications.

Titanium-based carbonitride alloys, usually named cermets, are well established as cutting tool material often used for finishing at high cutting speed. More recently, the area of application has been widened toward more toughness demanding applications which has been made possible by, i.e., increased binder phase and nitride contents in these alloys compared to tungsten-based, more brittle hard materials. Another way of obtaining increased toughness is disclosed in U.S. Pat. No. 5,137,565 in which extremely fine-grained alloys are made using melt metallurgically-made intermetallic pre-alloys.

During sintering of titanium-based carbonitride alloys, a solution-precipitation process takes place. As a result, a very common structure in such alloys is hard constituent grains with a core-rim structure. An early patent in this area is U.S. Pat. No. 3,971,656, hereby incorporated by reference, discloses Ti- and N-rich cores and rims rich in Mo, W and C. By a suitable combination of core-rim-structures in well-balanced proportions, optimal properties regarding wear resistance, toughness behavior and/or-plastic deformation can be obtained as disclosed in U.S. patent application Ser. No. 07/543,474, hereby incorporated by reference.

U.S. patent application Ser. No. 07/878,984, hereby incorporated by reference, discloses a titanium-based carbonitride alloy with coarse grains with core-rim structure in a more fine-grained matrix.

EP 447,388 and EP 464,396 disclose manufacturing of carbonitrides directly by carbonitriding of the oxides of the metals or the metals themselves.

OBJECTS AND SUMMARY OF THE INVENTION

It is an object of this invention to avoid or alleviate the problems of the prior art.

It is further an object of this invention to provide an improved sintered carbonitride alloy having titanium as the main component intended preferably for metal cutting applications and a method of making same.

In one aspect of the invention there is provided a sintered titanium-based carbonitride alloy for metal cutting containing hard constituents based on Ti, Zr, Hf, V, Nb, Ta, Cr, Mo and/or W and 3–30% binder phase on Co and/or Ni, said alloy containing coarse hard constituent grains essentially without core-rim structure with a mean grain size of 0.8–5 μm in a more fine-grained matrix with a mean grain size of the hard constituents of <1 μm, where said mean grain size of the coarse hard constituent grains is >1.5 times greater than the mean grain size for the grains in said matrix and the amount of coarse hard constituents is 10–50% by weight of said matrix, said matrix being made from a powder being prepared from an intermetallic pre-alloy disintegrated to <50 μm particle size and then carbonitrided in situ to extremely fine-grained hard constituents having a diameter <0.1 μm within the binder phase metals.

In another aspect of the invention there is provided a method of manufacturing a sintered titanium-based carbonitride alloy where the hard constituents are based on Ti, Zr, Hf, V, Nb, Ta, Cr, Mo and/or W and with 3–30% binder phase based on Co and/or Ni comprising casting a pre-alloy of hard constituent forming and binder phase forming metals without intentional additions of C, N, B and/or O to form a cast pre-alloy of brittle intermetallic phases of hard constituent forming metals and binder phase forming metals mixed in atomic scale, forming a powder of a grain size <50 μm of the said pre-alloy, carbonitriding said powder to form in situ extremely fine-grained hard constituent particles having a diameter <0.1 μm within the binder phase metals, mixing said powder with at least one hard constituent having a more coarse grain size, milling said mixture, pressing said mixture and sintering said present body to form said alloy.

DETAILED DESCRIPTION OF THE PREFERRED EMBODIMENTS OF THE INVENTION

Figure 1:
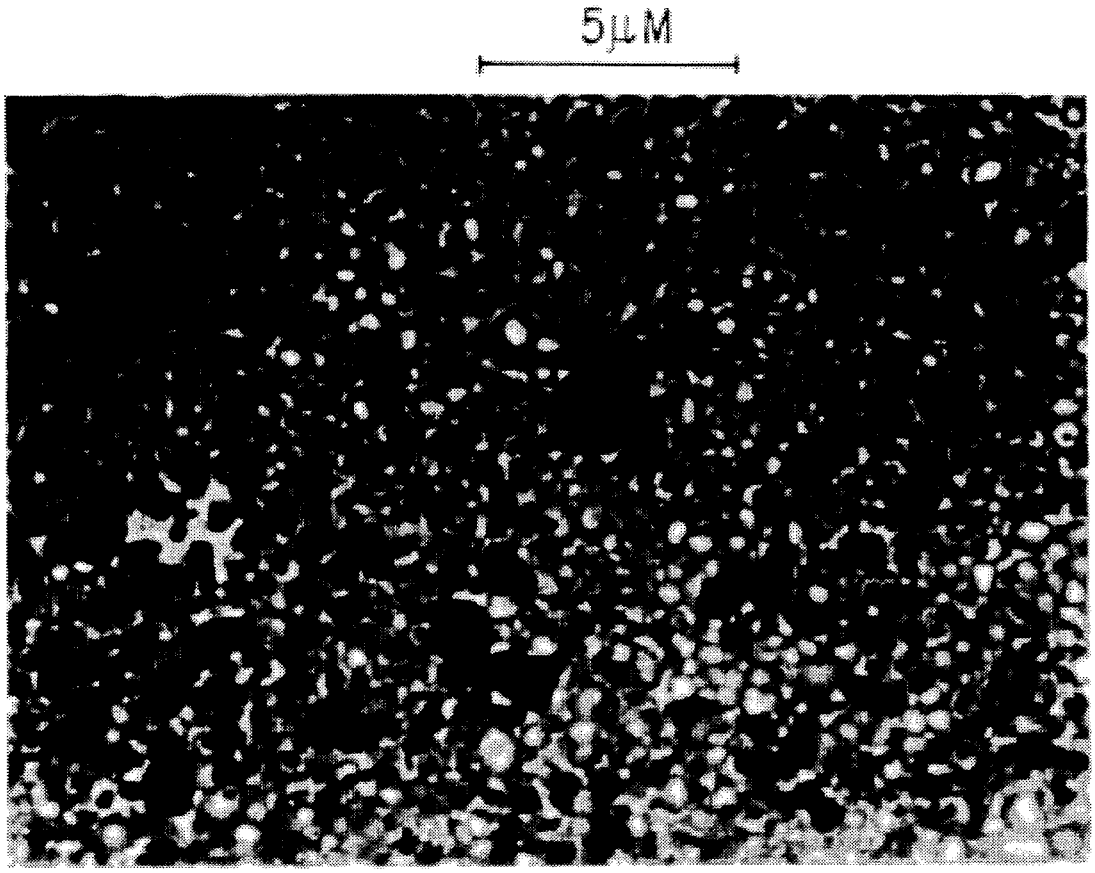
FIG. 1 shows in about 5000×magnification, the microstructure of an alloy according to the present invention.

According to the present invention, it has now been found that it is possible to further improve the toughness behavior and/or wear resistance properties of material according to U.S. patent application Ser. No. 07/878,984. By adding additional, more coarse-grained hard constituents to original pre-alloyed powder, a material with improved wear resistance and/or a significant improvement in toughness behavior relative to the original material is obtained.

According to the present invention, there is now provided a titanium-based carbonitride alloy with 70–97% by volume hard constituents, in which titanium is the dominating hard constituent former, i.e., more than 50 mole-% of the metallic elements are titanium. Additional metals present are Zr, Hf, V, Nb, Ta, Cr, Mo and/or W. Small additions of Al may be present, usually in the binder phase, which is based on Fe, Ni and/or Co, preferably Ni and/or Co.

The material according to the present invention is manufactured in two steps. In the first step, disclosed in the above-mentioned U.S. patent application Ser. No. 07/878,984, a powder is made by a method comprising casting a pre-alloy of hard constituent forming and binder phase forming metals without intentional additions of C, N, B and/or O to form a cast pre-alloy of brittle intermetallic phases of hard constituent forming metals and binder phase forming metals mixed in atomic scale. The alloy is then disintegrated into a powder of a grain size <50 μm. This powder is carbonitrided to form in situ extremely fine-grained hard constituent particles with a diameter of <0.1 μm within the binder phase metals. In this way, a ready-to-press powder is obtained in which no additives of powder other than very high melting and consequently melt metallurgically difficult to handle phases are present. Powder manufactured in this way is, thus, characterized by its fine-grained particles, ≦0.1 μm. In the second step, the additional hard constituents according to the present invention are added which gives the material special properties due to a unique structure in the sintered state. The said additional hard constituents comprise carbides, nitrides and/or carbonitrides of metals from the groups IV, V and VI of the Periodic System of the elements, preferably Ti(C,N), (Ti,Ta)C, (Ti, Ta)(C,N), (Ti,W)(C,N), (Ti,Ta,V)(C,N) and/or (Ti,Ta,W)(C, N), etc., depending on the desired property profile of the sintered alloy.

The additional hard constituent powders preferably have essentially equiaxial grains with a narrow grain size distribution and high chemical purity, preferably being produced directly by carbonitriding of the oxides of the metals or of the metals themselves. The mixing with powder obtained in the first step above shall in such case take place in a very careful manner in order to avoid excessive milling. One way of obtaining a good mixture is first to make sure that the additional hard constituent powder is deagglomerated in a separate step and after that mixing of the powders in a conventional dry mixer. Another way is to add said powder immediately before the end of the milling time.

In an alternative, more wear resisting embodiment, the additional hard constituents are predominantly added as agglomerates with a diameter of 20–200 μm, preferably 40–80 μm, and care is taken not to crush the agglomerates and yet obtain a good mixing.

In addition, it is very important to choose the grain size of the additional hard constituents such that after the sintering, they have a mean grain size of 1.5–15, preferably 1.5–5, times greater than the mean grain size of the pre-alloy matrix which is <1 μm. Suitable grain size of the additional hard constituent powders is consequently 0.8–5 μm, preferably 0.8–3 μm.

Suitable contents of the additional hard constituents are 10–50 weight-%, preferably 20–40 weight-%, of the pre-alloyed powder.

The milled mixture of pre-alloyed powder and additional hard constituents is used for the manufacture of cutting inserts with known methods such as spray drying, pressing and sintering.

A sintered structure of a material according to the present invention is shown in FIG. 1 and is characterized by a very fine-grained pre-alloyed matrix in which the hard constituent particles have a core-rim structure. The additional hard constituent grains (black in the image) more or less well-dispersed in this matrix have preserved their virgin character, i.e., they essentially lack rims and remain with their original morphology, chemical composition and grain size.

Figure 2A:
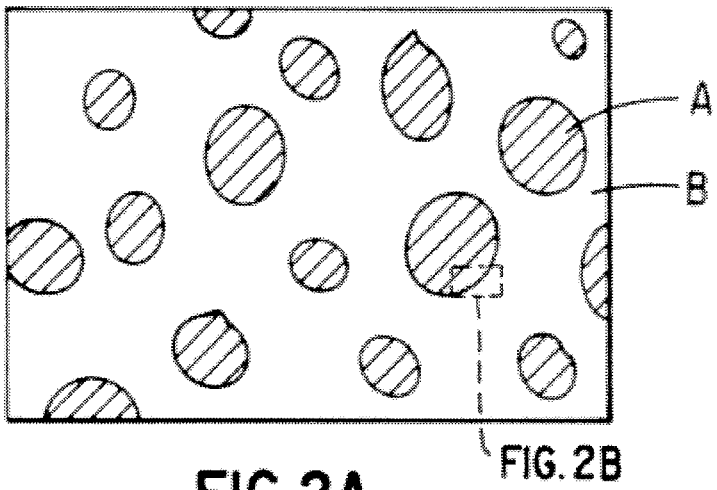
FIG. 2A represents the microstructure of an alternative embodiment of an alloy of the present invention.
Figure 2B:
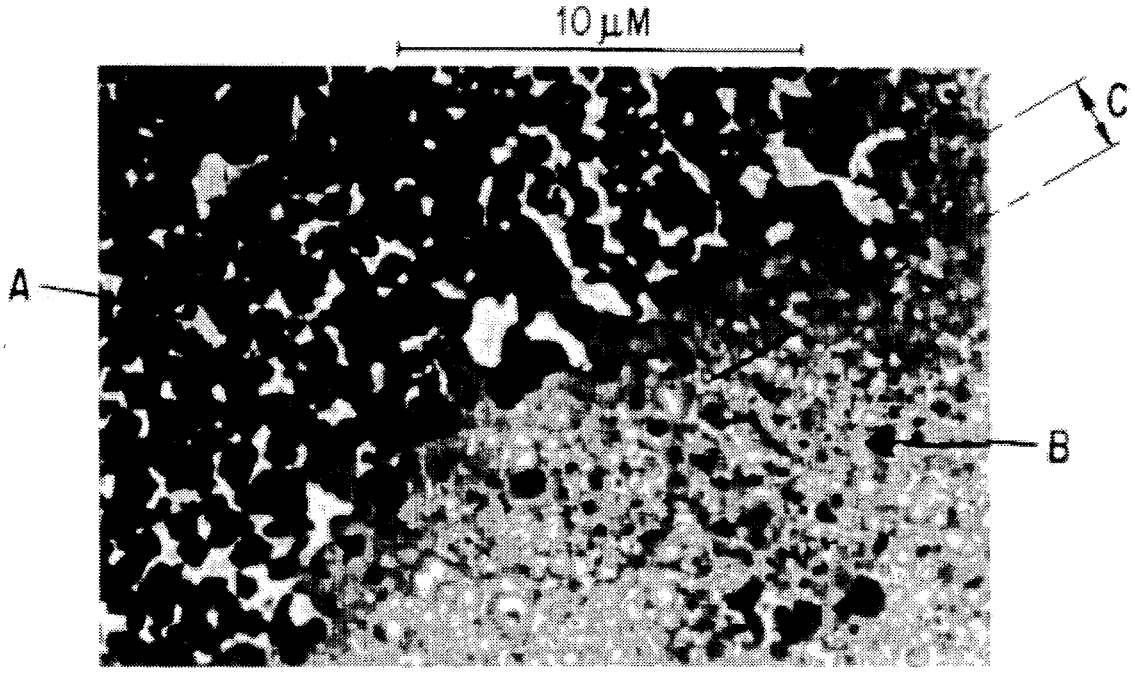
FIG. 2B shows in about 5000×magnification, the microstructure of a portion of an alternative embodiment of an alloy according to the present invention in which A is the agglomerate, B is the matrix and C is the transitional zone.

FIG. 2 shows the microstructure of the alternative embodiment. A is an agglomerate filled with binder phase in the fine-grained matrix, B. As in FIG. 1, the hard constituent grains of the agglomerates essentially lack rims and remain with their original morphology, chemical composition and grain size. The agglomerates are surrounded by a few μm thick zone C depleted in binder phase.

Cutting inserts according to the present invention show superior wear resistance and also toughness properties compared to known cutting inserts. There are several reasons to this. Adding additional hard constituents to a given hard material composition means that it is possible to increase the share of hard constituents with a corresponding decrease in the total binder phase content which, of course, increases the wear resistance. That the toughness as in this case also increases might be due to the resulting structure. As mentioned, the mean grain size of the additional hard constituents is greater than the fine-grained pre-alloyed fraction. This means, however, that the binder phase volume relative to the hard constituent volume increases and, thus, counteracts a decrease in toughness. In addition, the additional hard constituents are present not as usual in conventional titanium-based carbonitride alloys in the sense that said hard constituents almost completely lack the rim structure which is known to be the brittle phase in such alloys. Yet another possible explanation to the improved toughness behavior is the fact that additions of, e.g., $TiC_{0.5}N_{0.5}$ or $TiC_{0.3}N_{0.7}$ to a carbide rich starting composition lead to a more nitride-rich total composition which of course is favorable from a toughness point of view. It can not be excluded that the structure obtained gives rise to favorable inner stresses which may have crack stopping effects which leads to the good toughness behavior.

The invention is additionally illustrated in connection with the following Examples which are to be considered as illustrative of the present invention. It should be understood, however, that the invention is not limited to the specific details of the Examples.

Example 1

A pre-alloy of the metals Ti, Ta, V, Co, Ni was made in a vacuum induction furnace at 1450° C. in Ar protecting gas (400 mbar). The composition of the ingot after casting in the ladle was in % by weight: Ti 66, Ta 8, V 6, Ni 8 and Co 12. After cooling, the ingot was crushed to a grain size ≦1 mm. The crushed powder was milled together with necessary carbon addition in a ball mill with paraffin as milling liquid to a grain size ≦50 μm. The mixture was poured on a stainless plate and placed in a furnace with a tight muffle. The removal of the milling liquid was done in flowing hydrogen gas at the temperature 100°–300° C. After that, the powder was carbonitrided in solid phase by addition of nitrogen gas. The total cycle time was 7 hours including three evacuations in order to retard the procedure. The carburizing occurs essentially at the temperature 550–900° C. Then the final carbonitride charge was cooled in nitrogen gas.

The finishing powder manufacture was done in conventional ways, i.e., additional powders (WC and $Mo_2C$) were added and milled together with the carbonitride charge to final powder which was spray dried in usual ways.

This powder was wet mixed with 20% by weight TiCN 50/50 with spherical morphology and with mean grain size 1.4 μm (FSSS). This powder was not yet deagglomerated. The mixture was stirred with reduced speed in a ball mill for 30 minutes and spray dried to ready-to-press powder.

Example 2

Inserts of type TNMC 160408 QF were manufactured of pre-alloyed powder without addition of additional hard constituents according to Example 1 (alloy A) with the following metal composition in mole-%, Ti 62.4, Ta 2.3, V 4.7, W 6.2, Mo 7, Co 10 and Ni 7.4. An alloy according to the invention of Example 1, i.e., alloy A, with an addition of 20% by weight TiCN 50/50 was used for the manufacture of inserts with the same geometry (alloy B). The inserts of both alloys were sintered at the same time and had the same edge radius and rounding. They were tested in an interrupted cutting operation until fracture. 20 inserts of each alloy were tested. Cutting data at the initial engagement was:

V=110 m/min $f_o$=0.11 mm/rev a=1.5 mm

Work piece material=SS 2244

The feed was increased linearly until all of the inserts had fractured. Thereafter, the accumulated fracture frequency was determined as a function of the time to fracture. The 50% value fracture frequency for a certain feed in mm/rev is used as comparison number for the toughness behavior.

| Result: | |
|---|---|
| Alloy A | 0.145 |
| Alloy B, according to the present invention | 0.22 |

Looking at the individual results, alloy B wins in 19 cases out of 20. The result is, thus, statistically very convincing.

A wear resistance test was also performed with the same alloys. Test 1 was longitudinal turning in SS 2541 with the following cutting data:

V=400 m/min $f_o$=0.15 mm/rev a=1.0 mm

The flank wear was measured continuously. Three tests were run. VB after 15 minutes engagement time is given in the table below (VB in 1/10 mm).

| | 1 | 2 | 3 | Average |
|---|---|---|---|---|
| Alloy A | 0.35 | 0.36 | 0.29 | 0.33 |
| Alloy B (invention) | 0.21 | 0.24 | 0.24 | 0.23 |

The flank wear is as apparent significantly better for alloy B according to the present invention.

In the same work piece also tool life of the alloys was determined. The tool life criterion was plastic deformation. Cutting data were as above.

| | Tool life, min | | | |
|---|---|---|---|---|
| | 1 | 2 | 3 | Average |
| Alloy A | 20 | 16 | 17.5 | 17.8 |
| Alloy B (invention) | 63.5 | 35 | 27.5 | 42 |

The alloy according to the invention, thus, had a much better tool life.

Test 2 was a wear resistance test made as plane turning of tubes in SS 2234 with the following cutting data.

V=400 m/min $f_o$=0.15 mm/rev a=1.0 mm

Engagement time/section=0.11 minutes

As predetermined tool life VB=0.3 mm was chosen. This value was reached for alloy A after 130 sections (corresponding to 14.3 minutes) whereas alloy B, according to the invention, got the same VB after 185 sections (corresponding to 20.4 minutes). Again, a pronounced difference, thus, in favor of alloy B is found. Complete tool life was not tested in this operation. None of the alloys had fracture after this predetermined VB-value.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A sintered titanium-based carbonitride alloy for metal cutting containing hard constituents of carbonitrides based on Ti, Zr, Hf, V, Nb, Ta, Cr, Mo and/or W and 3–30% binder phase based on Co and/or Ni or their alloys, said carbonitride alloy containing coarse hard constituent grains essentially without core-rim structure with a mean grain size of 0.8–5 μm in a matrix of binder phase and fine-grained hard constituents with a mean grain size of the hard constituents of <1 μm, where said mean grain size of the coarse hard constituent grains is >1.5 times greater than the mean grain size for the grains in said matrix and the amount of coarse hard constituents is 10–50% by weight of said matrix, said matrix being made from a powder being prepared from an intermetallic pre-alloy disintegrated to <50 μm particle size and then carbonitrided in situ to extremely fine-grained hard constituents having a diameter <0.1 μm within the binder phase metals, said coarse hard constituent grains have been produced by carbonitriding of the metals or their oxides and are essentially equiaxial with a narrow grain size distribution.

2. The sintered carbonitride alloy of claim 1 wherein said coarse hard constituent grains comprise Ti(C,N), (Ti,Ta)(C,N), (Ti,W)(C,N), (Ti,Ta,V)(C,N) and/or (Ti,Ta,W)(C,N).

3. A method of manufacturing a sintered titanium-based carbonitride alloy where the carbonitride hard constituents are based on Ti, Zr, Hf, V, Nb, Ta, Cr, Mo and/or W and with 3–30% binder phase of Co and/or Ni comprising casting a pre-alloy of hard constituent forming and binder phase forming metals without intentional additions of C, N, B and/or O to form a east pre-alloy of brittle intermetallic phases of hard constituent forming metals and binder phase forming metals mixed in atomic scale, forming a powder of a grain size <50 μm of the said pre-alloy, carbonitriding said powder to form in situ extremely fine-grained hard constituent particles having a diameter <0.1 μm within the binder phase metals and mixing said powder with at least one, agglomerated and/or deagglomerated, hard constituent produced by carbonitriding the metal, their oxides separately from said carbonitriding to produce said fine-grained hard constituent particles and having a more coarse grain size, milling said mixture, pressing said mixture and sintering said present body to form said alloy, wherein said coarse hard constituent grains are essentially equiaxial with a narrow grain size distribution.

4. The method of claim 3 wherein said coarse hard constituent grains comprise Ti(C,N), (Ti,Ta)(C,N), (Ti,W)(C,N), (Ti,Ta,V)(C,N)and/or (Ti,Ta,W)(C,N).

* * * * *